US005810702A

United States Patent [19]

Wilkinson

[11] Patent Number: 5,810,702

[45] Date of Patent: Sep. 22, 1998

[54] PORTABLE EXERCISE DEVICE

[76] Inventor: William T. Wilkinson, P.O. Box 73, Salem, N.J. 08079

[21] Appl. No.: 689,056

[22] Filed: Jul. 30, 1996

[51] Int. Cl.[6] ..... A63B 23/02

[52] U.S. Cl. ..... 482/142; 482/130; 482/907

[58] Field of Search ..... 297/15, 217.7, 297/327; 482/147, 142, 146, 130, 33, 140, 143, 144, 148, 907, 904

[56] References Cited

U.S. PATENT DOCUMENTS

| | | | |
|---|---|---|---|
| 4,492,376 | 1/1985 | Schatz et al. | 482/129 |
| 4,815,732 | 3/1989 | Mahvi | 482/142 |
| 5,078,389 | 1/1992 | Chen | 482/147 |
| 5,320,591 | 6/1994 | Harman et al. | 482/129 |
| 5,607,381 | 3/1997 | Endelman | 482/142 |

FOREIGN PATENT DOCUMENTS

| | | | |
|---|---|---|---|
| 2157792 | 5/1973 | Germany | 482/142 |

*Primary Examiner*—Jerome Donnelly
*Attorney, Agent, or Firm*—Connolly & Hutz

[57] ABSTRACT

A portable exercise device comprises a rigid planar base having a horizontal upper surface. At least one support bracket is mounted to the upper surface. A generally vertically disposed pole is mounted to the support brackets at one of a co-arcuate array of positioning locations on the brackets to vary the angular orientation of the pole. The pole may also be disposed in a completely collapsed horizontal condition during transportation and storage of the device. The base has hand accommodating structure to facilitate the carrying of the base. A body supporting member, such as a bench, may be mounted to the pole and the base. In addition, a rigid exercise bar could be mounted to the pole. A plurality of elastic exercise cords could be mounted to the base.

32 Claims, 12 Drawing Sheets

9
10
13
3
32
34
36
38
40
42
44
46
48
50
52
54
74
22
16
18
20
14
12
1
84
28
26
30

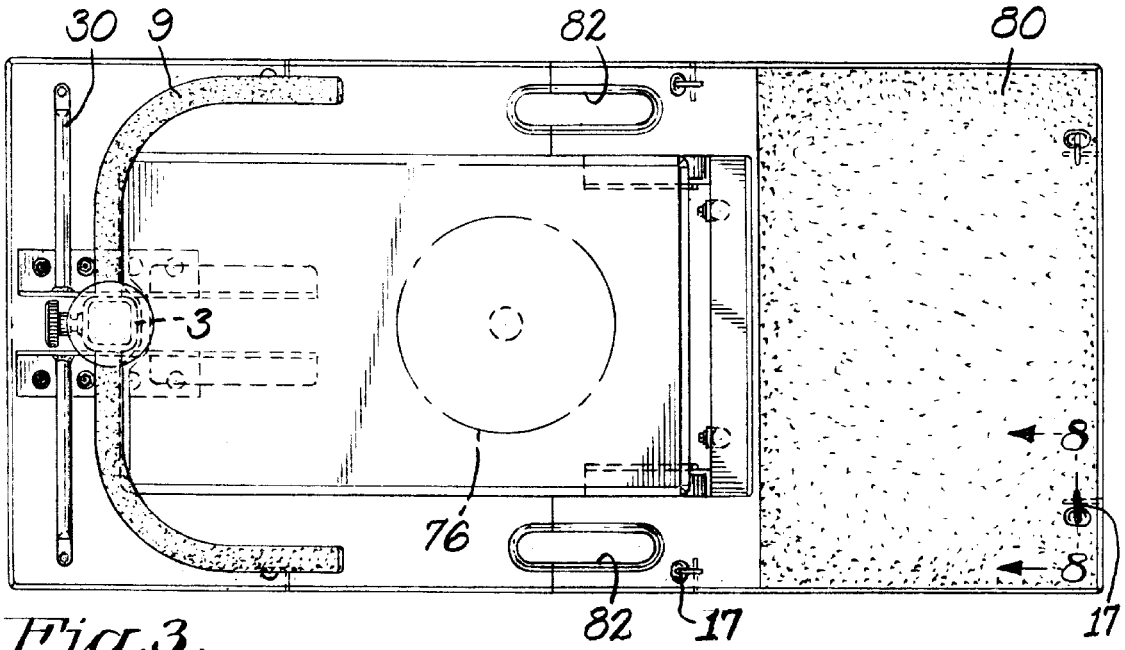
Fig. 3.
Fig. 5.
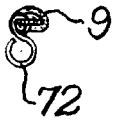
Fig. 4.
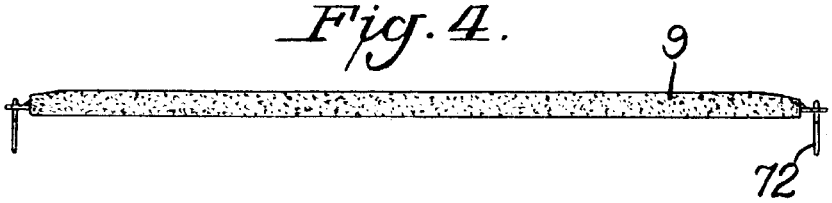
Fig. 6.
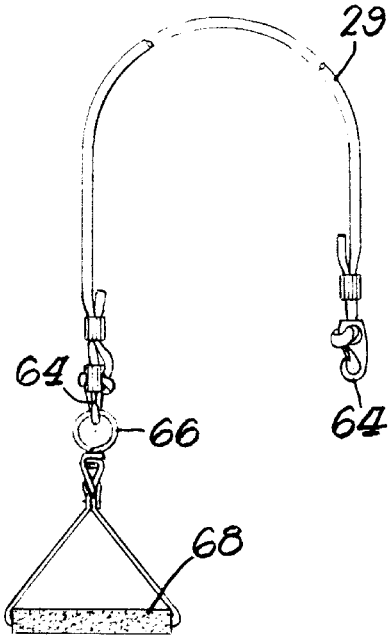
Fig. 7.
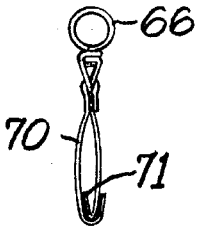
Fig. 8.
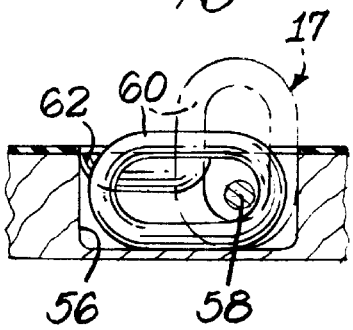

PORTABLE EXERCISE DEVICE

BACKGROUND OF THE INVENTION

There is a growing consciousness of the desirability to keep fit by exercising. Various fitness clubs provide different types of exercise equipment which could be used. Such fitness clubs, however, are not always convenient. It would be desirable if a home exercise device could be provided, particularly one which could be portable so that it could be easily stored and then easily set up for use while providing a choice from a multitude of different possible exercises.

SUMMARY OF THE INVENTION

An object of this invention is to provide a portable exercise device which accomplishes the above needs and desires.

A further object of this invention is to provide such a portable exercise device which affords the user with the selectability of various types of exercises.

A still further object of the invention is to provide such a portable exercise device which is low cost so that it can be afforded by a large segment of the population.

In accordance with this invention a rigid planar base is provided on which the user would perform the exercises. A vertical pole is adjustably mounted to the base by being selectively secured at varying positioning locations co-arcuately arranged on a bracket mounted to the base. The pole, may be selectively disposed in a completely collapsed or horizontal condition to facilitate the storage and transportation of the device.

Optionally, the device may include a body support member, such as a bench mounted to the base and to the pole. Another option includes having a rigid exercise bar preferably selectively mounted at different heights on the pole. Elastic exercise cords may also be provided anchored to the base or to the pole and having free ends which may be grasped by the user.

THE DRAWINGS

FIG. 3 is a top plan view of the device shown in FIGS. 1–2;

FIG. 4 is a side elevational view of a rigid exercise bar which could be used in the device shown in FIGS. 1–3;

FIG. 5 is a front elevational view of the exercise bar shown in FIG. 4;

FIG. 6 is a side elevational view of an elastic cord having a hand grip which may be used in the device in FIGS. 1–3;

FIG. 7 is a side elevational view of a foot attachment which may be used with the elastic cord of FIG. 6 in place of the hand grip;

FIG. 8 is a cross-sectional view taken through FIG. 3 along the line 8—8;

DETAILED DESCRIPTION

Figures 1, 2:
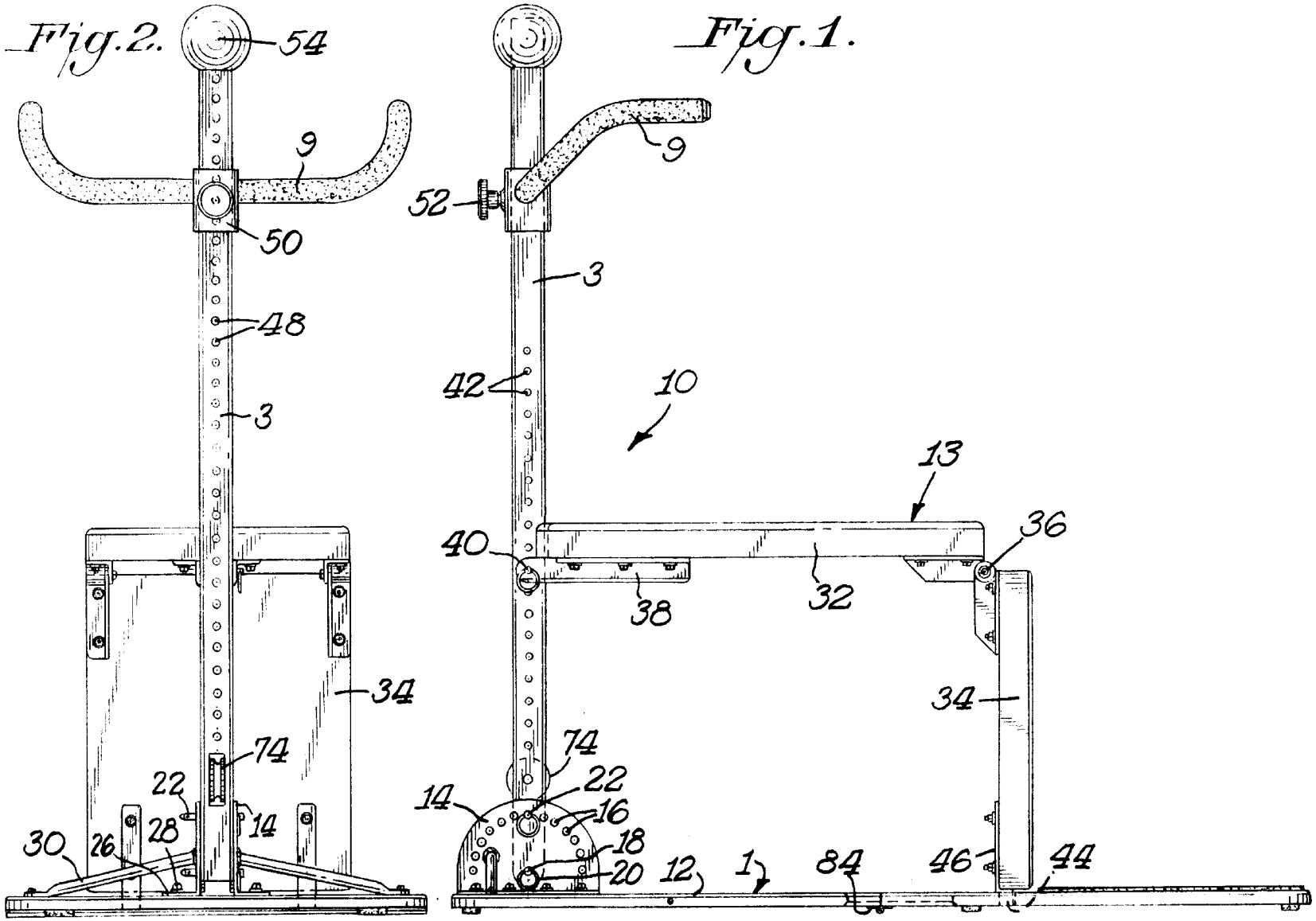
FIG. 1 is a side elevational view of a portable exercise device in accordance with this invention.
FIG. 2 is a front elevational view of the device shown in FIG. 1.

FIGS. 1–3 show a portable exercise device 10 in accordance with this invention. As shown therein device 10 includes a rigid planar base 1 having a horizontal upper surface 12. A pair of support brackets 14,14 is mounted generally centrally at one end of support surface 12. Each bracket 14 includes a co-arcuate array of positioning locations 16 on the bracket. In the illustrated practice of the invention these positioning locations are in the forms of holes wherein each hole is aligned with a corresponding hole of the other bracket.

As illustrated a generally vertically disposed pole 3 is secured to the brackets 14,14. Pole 3 would be pivotally mounted by pivot shaft 18 at the base of the brackets. Pivot shaft 18 may be a pin having a grasping loop 20 to facilitate removal of the pin when it is desired to detach the pole 3 for storage and/or transportation purposes. A further pin 22 is provided for selective engagement with a set of holes 16 and a corresponding hole in pole 3. Thus, the selection of the set of holes 16 in the brackets controls the angular orientation of pole 3 with respect to upper surface 12. Pin 22 may be easily removed by pulling on loop 24.

Brackets 14 may be mounted to base 1 in any suitable manner. For example, as illustrated the brackets include horizontal flanges 26 secured to base 1 by any suitable fasteners 28. To further add to the stability in mounting the brackets, particularly when considering that the pole 3 is mounted to the brackets, a side brace 30 is mounted to each bracket and to the base as best shown in FIG. 2.

Figure 11:
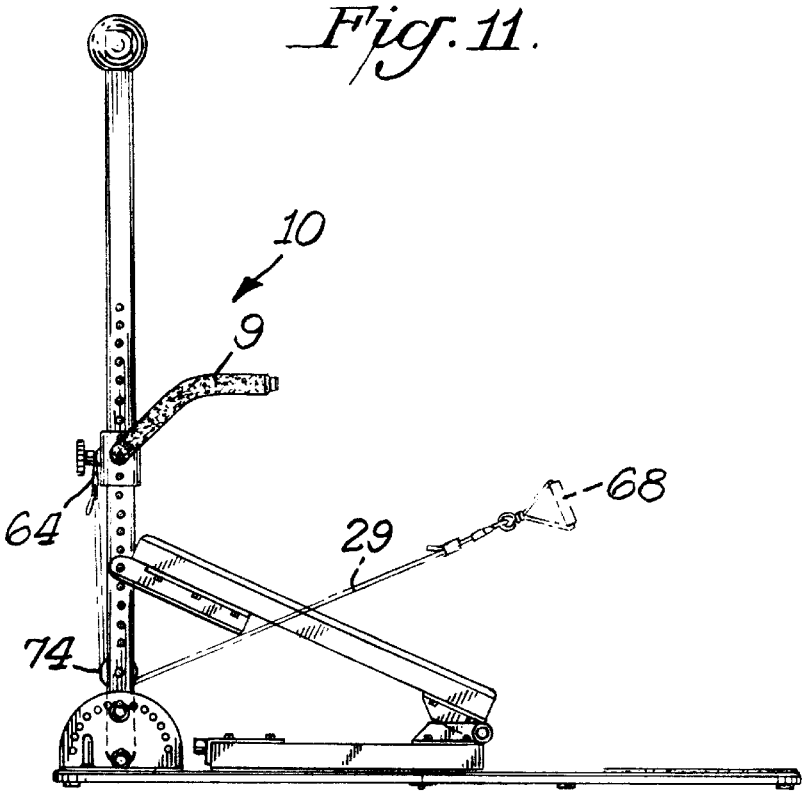
FIG. 11 is a side elevational view showing the exercise bench of FIGS. 1–3 in an inclined position.

As later described pole 3 may be used in the performance of various types of exercises through the use, for example, of other exercise equipment mounted to pole 3. FIGS. 1–3 illustrate the provision of a bench 13 which comprises two platforms 32,34 hinged together by hinge 36 as clearly shown in FIG. 1. Platform 32 is mounted to pole 3 by means of a bracket 38 extending against pole 3 on each side of pole 3 with a detachable pin 40 extending through holes in the brackets 38 and through one of a set of holes 42 along parallel sides of pole 3. As a result, it is possible to selectively mount platform 32 at different locations and angular orientations. Platform 34 in turn is mounted against base 1 in any suitable manner such as by positioning pins 44 extending from rigid L-shaped support 46. Pins 44 could be disposed in suitably located holes in base 1. FIG. 11 show the pins 44 exposed when bench 13 is in an inclined position.

Bench 13 thus may take various orientations such as having the two platforms 32,34 at generally right angles to each other as shown in FIG. 1 where the platform 32 would be the primary structure for supporting a part of the body. Alternatively, the two platforms 32,34 could be aligned with each other and both platforms, which are preferably padded, would support the body. See, for example, FIG. 21. Other variations include folding the bench in the manner shown in FIG. 11 so that the platform 32 supports the body and platform 34 is disposed below platform 32.

A further function of pole 3 is to provide a support on which an exercise bar such as T-bar 9 may be mounted. As illustrated in, for example, FIG. 2, pole 3 is provided with a further set of aligned holes 48 on its sides intermediate the sides having holes 42. T-bar 9 is mounted to a collar 50 which is slidably positioned over pole 3. Collar 50 includes a tightening knob 52 having a pin or screw that extends through the collar and would be selectively located in one of the holes 48 to control the height of T-bar 9. A padded generally spherical cap 54 is detachably mounted on the top of pole 3 to act as a cushioning member whereby there are no sharp edges at the top of pole 3. Cap 54 would be removed to permit the placement or removal of collar 50.

Figure 10:
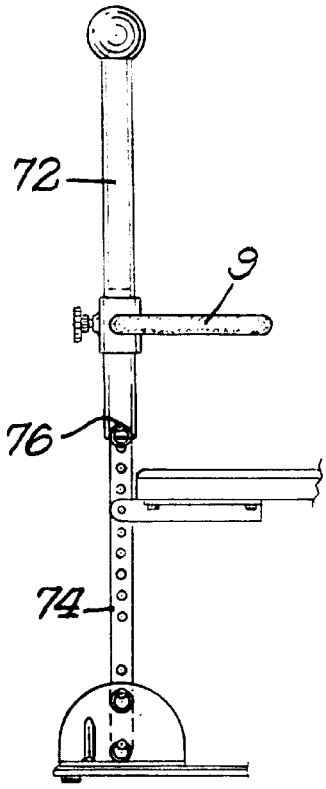
FIG. 10 is a side elevational view showing an alternative form of pole structure for the device in FIGS. 1–3.

T-bar 9 may take various forms. For example, as illustrated in FIGS. 1–2, T-bar 9 is generally a U-shaped bar having padding over a rigid core with offset handles or end portions. FIG. 4 shows a variation where the T-bar 9 is of straight configuration. FIG. 10 also shows the T-bar 9 to be a generally horizontal U-shaped bar illustrating a further structural variation of the rigid exercise bar. Various shapes and sizes may be used within the spirit of this invention.

A further feature of the invention is to provide the ability to mount elastic exercise cords as part of device 10. For example, as illustrated a number of cord anchors 17 would be located on upper surface 12 of base 1. FIG. 8 illustrates in greater detail one such anchor 17. As shown therein a recess or depression 56 is provided in base 1 with a retaining pin 58 located in depression 56 around which an elongated loop 60 is disposed. When no elastic cord is mounted to loop 60 the loop is in a generally horizontal condition only slightly extending from or completely within recess 56. The recess 56 may have an enlarged depression 62 to facilitate access to loop 60. When it is desired to attach a cord loop 60 is rotated 90° from the position shown in solid in FIG. 8 to the position shown in phantom. A cord, such as elastic cord 29, could then be secured in any suitable manner. FIG. 6, for example, shows a conventional snap fastener 64 at the end of cord 29. The opposite end of cord 29 could have a further snap fastener 64 to which any suitable connector such as a ring connector 66 may be mounted for thereby attaching a hand grip member 68. FIG. 7 shows an alternative wherein a loop member 70 is attached to connector 66 where the elastic cord is intended, for example, to be used by placing a foot in the loop 70.

Loop 70 may be made adjustable by providing adjustable fastening members such as hook and loop fasteners 71 at the free ends of two straps which when secured together form the foot strap or loop 70.

Elastic cords 29 may be mounted at various parts of device 10. FIGS. 4–5, for example, illustrate the rigid exercise bar 9 to include S-hooks 72 which may be used for having a connector 64 attached so that an elastic cord 29 may be mounted directly to the exercise bar. It is also possible to mount the elastic cords directly to pole 3 either by securing the connector 64 to a pin or other support in one of the holes such as holes 42 or 48 in pole 3. Alternatively, the elastic cord might simply be wrapped around more than 360° or wrapped partially around pole 3 without any other physical attachment. FIGS. 1–2 show an alternative wherein a pulley 74 is provided in pole 3 around which an elastic cord may be disposed. FIG. 11, for example, shows the use of pulley 74 where a connector 64 at one end of elastic cord 29 is mounted to knob 52 of collar 50 after being inserted around pulley 74 so that the other end of cord 29 has its hand grip 68 conveniently located as illustrated.

Device 10 may include other types of exercise structure. FIG. 3, for example, shows in phantom a twister 76 mounted under bench 13. Twister 76 may be used by detaching bench 13 from pole 3 and base 1. Twister 76 may take any suitable form such as shown in U.S. Pat. Nos. 5,284,461 and 5,407,408, the details of which are incorporated herein by reference thereto.

The invention might also be practiced by mounting an abdominal exercise device on base 1 or on bench 13, particularly when bench 13 is in an inclined position. Any suitable abdominal exercise device may be used such as shown in U.S. Pat. No. 5,492,520, the details of which are incorporated herein by reference thereto. The provision of an abdominal rocker on the bench when the bench is in the form of a slant board combines the advantages of both devices for developing abdominal muscles. The rocker provides neck support, rocking action and hand/arm support not provided with an abdominal board. The slant board contributes angle adjustability and padding for the user (by providing padding on the upper surface of the bench), as well as a location for anchoring the feet and providing lateral/side stability.

Pole 3 may take various forms. As shown in FIGS. 1–2 pole 3 is of one piece construction which is not adjustable in length. FIG. 10 illustrates a variation wherein pole 3 comprises an outer upper telescopic member 72 slidably mounted over a lower telescopic member 74. The overall length would be adjusted by a detachable adjusting pin 76 which would inserted in a set of holes 42 to prevent downward movement of outer member 72.

Pole 3 may also be of fixed length but made of plural pieces secured together in any suitable manner to form a rigid unitary poles. The pieces may be disconnected during storage or transportation condition to make the pole more compact.

Figure 9:
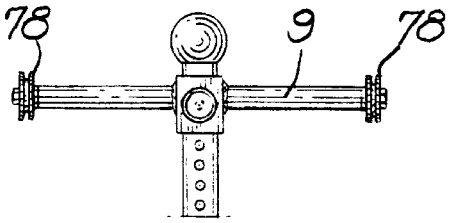
FIG. 9 is a fragmental front elevational view showing a rigid exercise bar with a pulley attachment which may be used with the device shown in FIGS. 1–3.

FIG. 9 illustrates a variation wherein the T-bar 9 has a pulley 78 mounted at each end around which, for example, an exercise cord may be disposed.

Base 1 may include padding such as padding 80 shown in FIG. 1 over some or all of upper surface 12.

One of the advantageous features of this invention is that device 10 functions as a portable exercise device. To facilitate the portability of device 10 finger grasping or handle structure is preferably provided. For example, FIG. 3 illustrates two enlarged oval openings 82 extending completely through base 1 of sufficient size that a user's hand may be inserted through each opening. Alternatively, but less preferred, the structure 82 may simply be dished out depressions or may be carrying loops or any other form of handle.

Preferably all portions of device 10 which are grasped or contacted by any portion of the user's body would be padded for comfort purposes.

A further feature of the invention which lends itself to storage is that the various components mounted on base 1 may be manipulated to be located in a collapsed or completely detached condition. Thus, for example, bench 13 could be completely detached from pole 3 and base 1. Pole 3 could be pivoted to a completely horizontal position against upper surface 12 or could be completely detached. The various rigid exercise bars could also be completely detached. In the preferred practice of this invention base 1 itself is made of hinged construction to permit the device to be rendered more compact for storage and transportation. FIG. 1, for example, shows hinge construction 84 transversely across the central portion of base 1. It is preferred to utilize a hinge construction that would cause the under surfaces of the two portions of base 1 to be in contact with each other. In other words, as shown in FIG. 1, the hinging action at the extreme right hand portion of base 1 would be in a clockwise direction so as to resist any hinging of base 1 when the user is pulling on an elastic cord mounted to the end portion of base 1. Alternatively, the hinge structure may be longitudinally along base 1 which would permit the width of base 1 to be made more narrow while leaving the length the same size.

Figure 13:
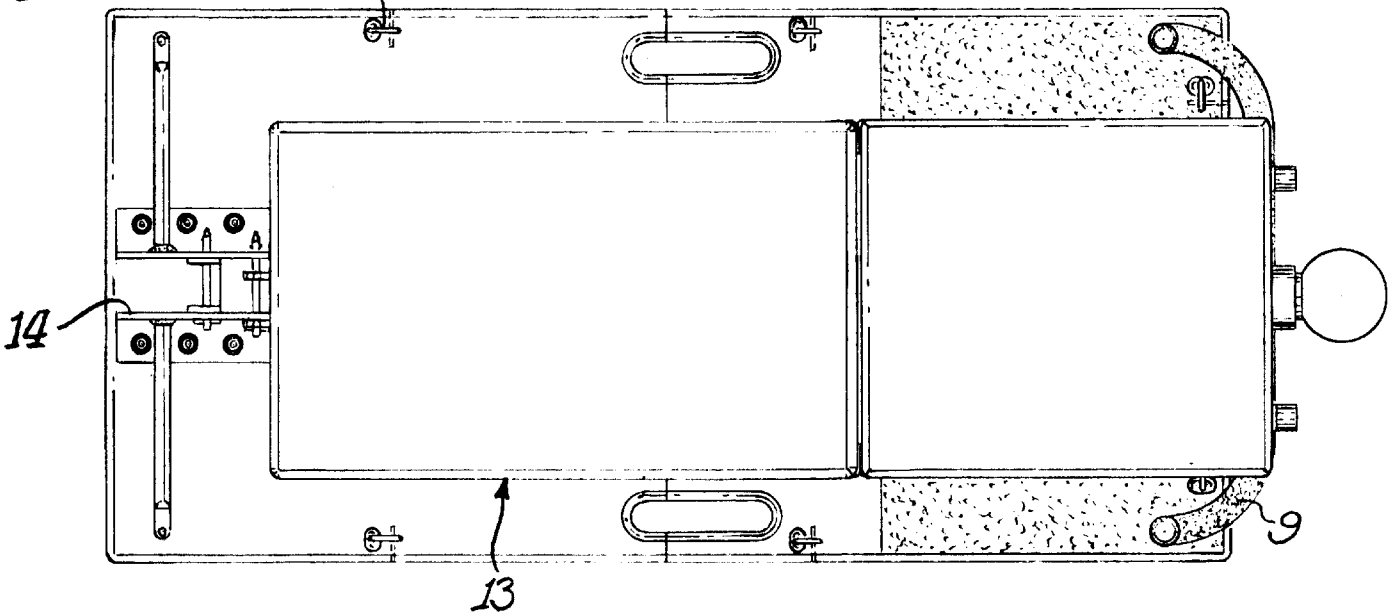
FIG. 13 is a top plan view of the device shown in FIG. 12.
Figure 12:
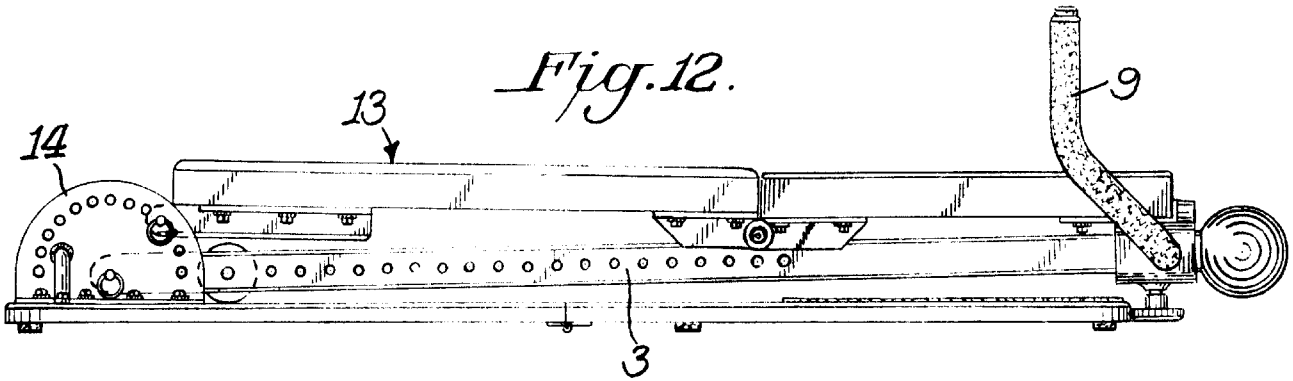
FIG. 12 is a side elevational view showing the device of FIGS. 1–3 in a folded condition for storage.

FIGS. 12–13 show the various main components of device 10 in a collapsed condition. As shown therein base 1 remains in its original length with pole 3 mounted generally horizontally on base 1. Bench 13 in turn is mounted directly over pole 3. These components may be held in their collapsed condition by straps or other fasteners.

An alternative preferred manner of folding would be to fold bench 13 directly against base 1. Such folding would be after base 1 is folded upon itself if base 1 has suitable hinge structure. Pole 3 would then be folded over bench 13. In order to provide sufficient clearance to permit pole 3 to be horizontally disposed over bench 13, brackets 14,14 are of sufficient height so that when pin 18 is removed, pole 3 pivots about pin 22 until it is horizontally disposed over and against bench 13.

Figure 14A:
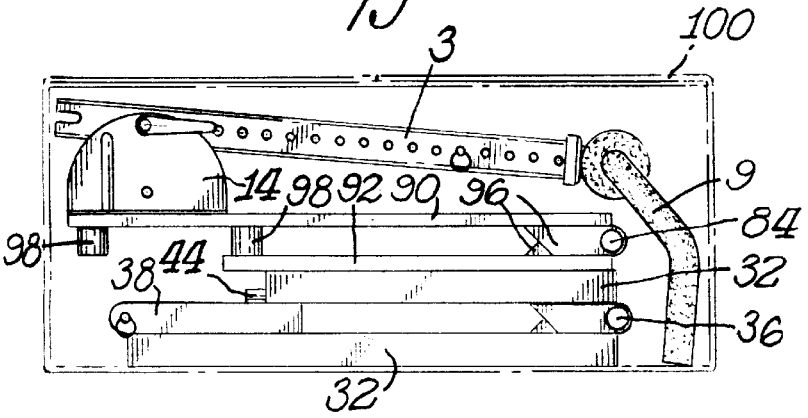
FIG. 14A is a view similar to FIG. 14 showing the device of FIG. 1A mounted in a carton during storage.
Figure 14:
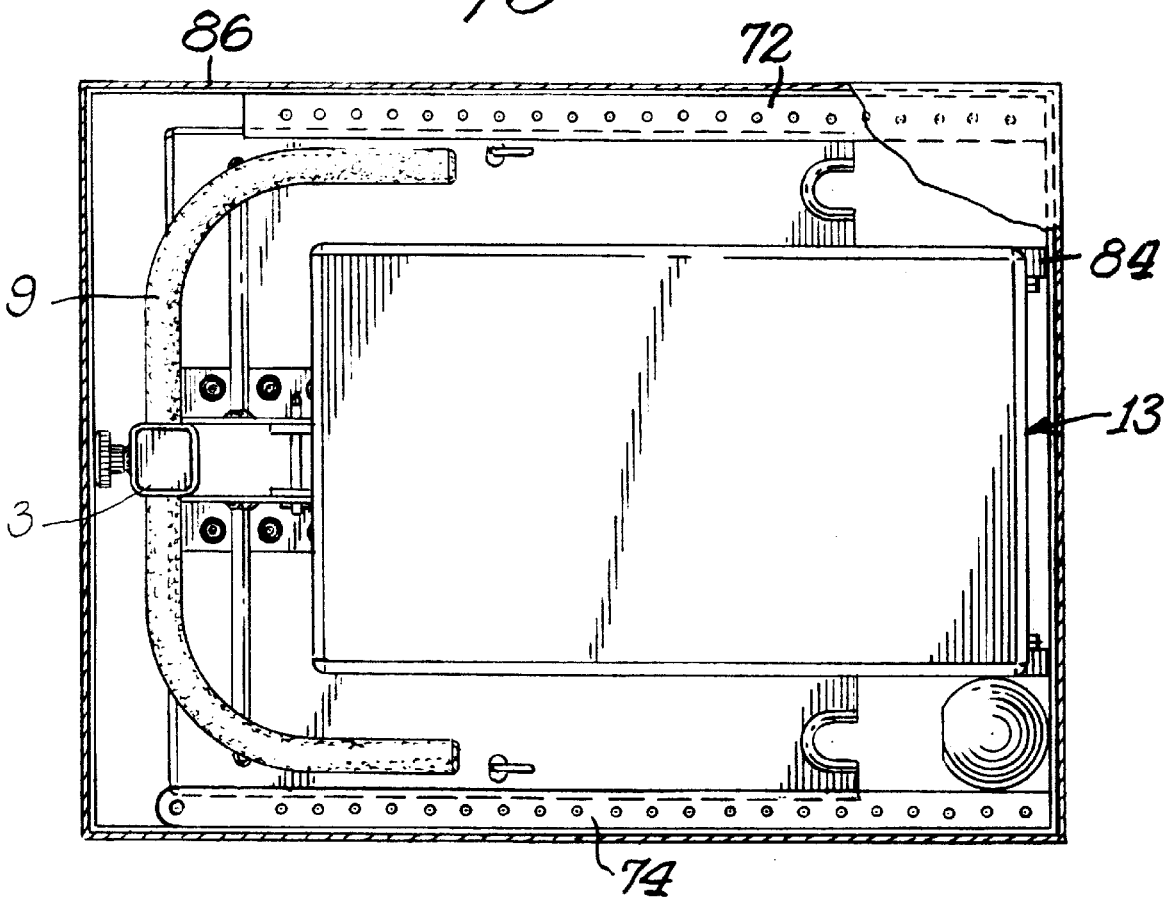
FIG. 14 is a top plan view showing the device of FIGS. 12–13 with the pole of FIG. 10 mounted in a carton during storage.

FIG. 14 shows the components of device 10 folded into a more compact condition for storage, for example, in a carton 86. In this illustrated form the pole 3 includes telescopic sections 72,74 which may be completely detached from each other.

Figure 1A:
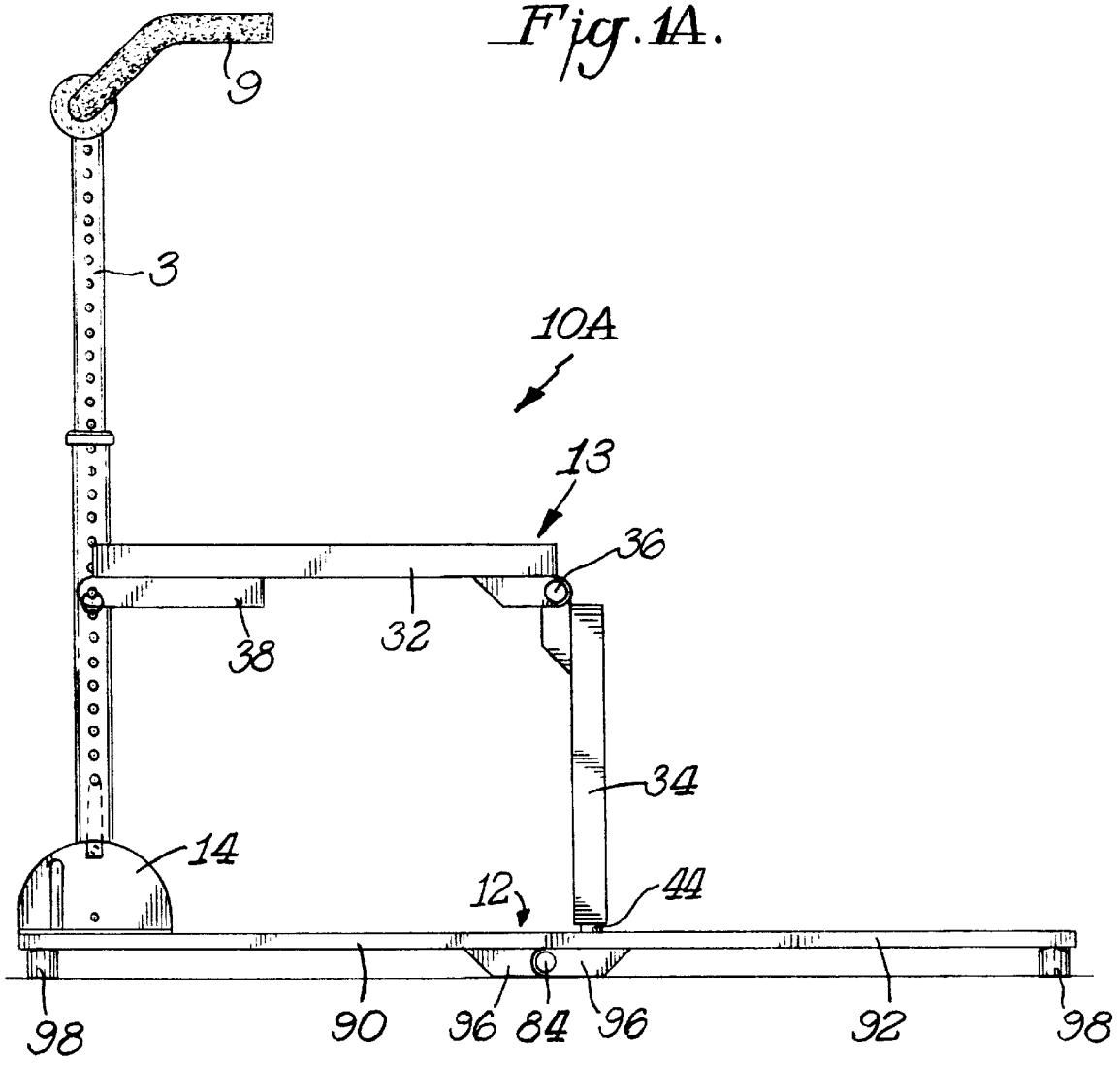
FIG. 1A is a side elevational view of an alternative form of portable exercise device in accordance with this invention.

FIG. 1A shows a variation of the device 10 shown in FIG. 1. As shown in FIG. 1A the support surface 12 includes a hinge structure 84 interconnecting two flanges 96,96 with each flange extending downwardly from a respective portion 90,92 of the two piece support surface 12. The flanges 96 extend downwardly the same amount as feet 98,98 to provide further support for the support surface 12. Similar feet could also be incorporated in the device 10 of the embodiment shown in FIG. 1.

FIG. 14A shows the manner of compactly folding and storing device 10A. As shown, therein the pole 3 is completely detached from bench 13 and support surface 12. Similarly, bench 13 is completely detached from support surface 12. When the components are placed in carton or storage container 100, bench 13 is folded with platform 32 lowermost. The thickness of flanges 96,96 is the same as the thickness of brackets 38 so that platform 34 would then be folded in a horizontal orientation on brackets 38 with pins 44 extending outwardly from platform 32. Next support surface 12 is folded and placed in carton 100. This is done by folding portion 92 below portion 90 and resting portion 92 directly on platform 32. Finally, pole 3 with its T-bar 9 is loosely placed in carton 100.

If desired, non-slip material may be provided on portions of device 10 such as on upper surface 12 where the user is likely to stand while performing some form of exercise. Thus, instead of padding 80 known non-slip material such as ribbed-rubber may be used.

Figure 15:
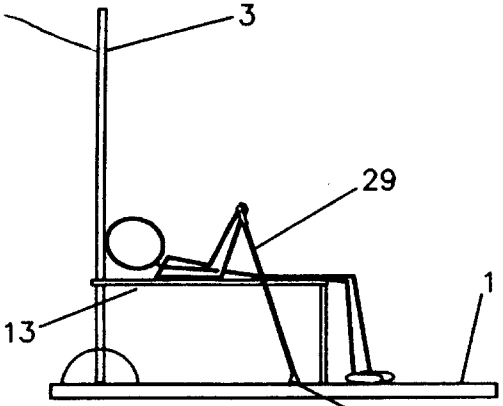
FIGS. 15–49 are schematic views showing various types of exercises that could be performed with the exercise device of this invention.

A series of arm exercises can be performed with the invention as shown in the FIGS. 15 through 26. The schematic in FIG. 15 depicts an exerciser performing chest presses. In this use the exerciser lays on his or her back and stretches elastic cords 29 attached to elastic cord anchors positioned in the middle of the planar base away from his or her body with his or her arms.

Figure 16:
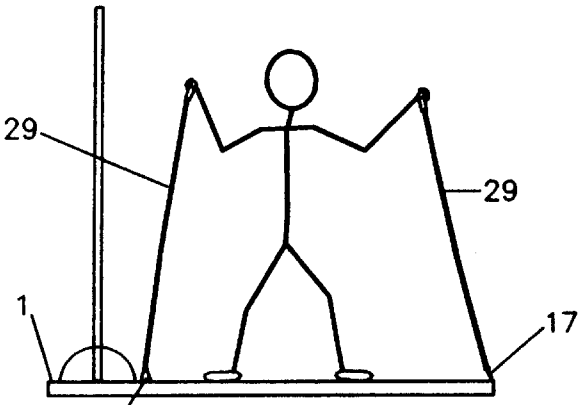

Overhead presses are depicted in the schematic of FIG. 16. In this use the exerciser stretches the two elastic cords 29 with his arms over his or her head. Each elastic cord is attached to the elastic cord anchors 17 at the extreme ends of the planar board 1.

Figure 17:
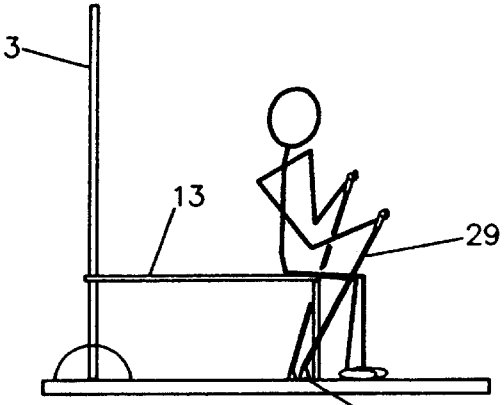

FIG. 17 depicts an exerciser using the invention to do sitting curls. Here the exerciser sits on the bench 13 at the end opposite from the pole 3 with his or her back to the pole. The exerciser stretches the elastic cord 29 with his or her arms and the other ends of the elastic cords 29 attached to the elastic cord anchors 17.

Figure 18:
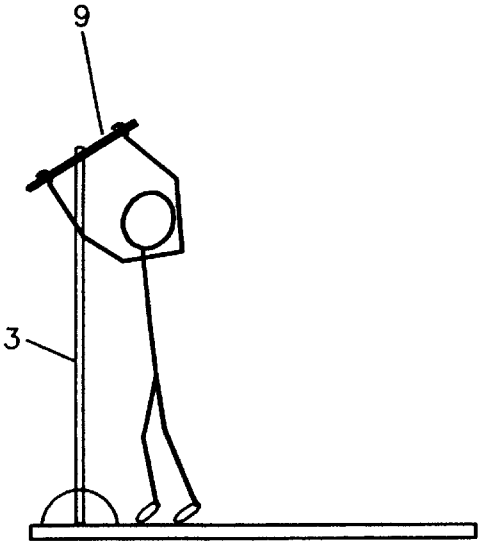

Pull ups can be performed with the invention. The schematic in FIG. 18 depicts how to use this invention to do pull ups. The t-bar 9 is attached at the proper height to the pole 3 locked in the vertical position and the exerciser can lift himself or herself from the t-bar 9.

Figure 19:
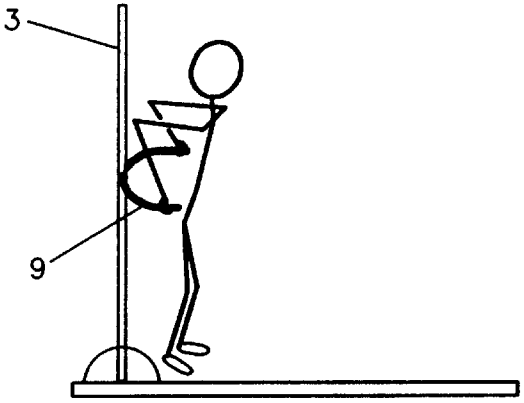

The schematic in FIG. 19 shows an exerciser performing dips with the curved t-bar 9 attached at the proper position to the pole 3 which is locked in the vertical position.

Figure 20:
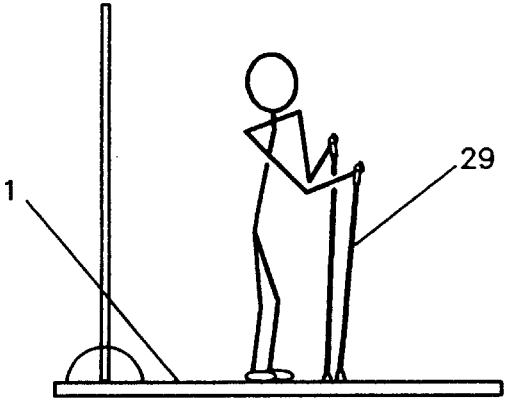

Standing curls can be performed as shown in FIG. 20 by the exerciser standing on the planar base 1 and stretching the elastic cords 29 with his or her arms and the other ends of the elastic cord 29 attached to the elastic cord anchors 17.

Figure 21:
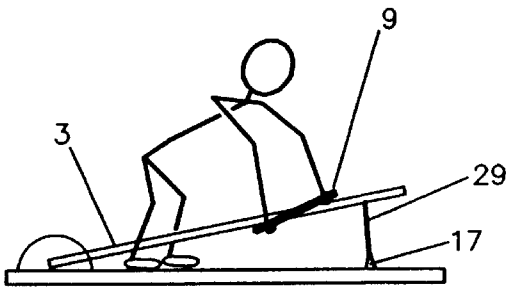

FIG. 21 depicts an exerciser performing rows. Here the t-bar 9 is positioned on the pole 3 and the exerciser lifts the t-bar 9 which is restricted by the elastic cord 29 attached to the pole 3 and the elastic anchor 17.

Figure 22:
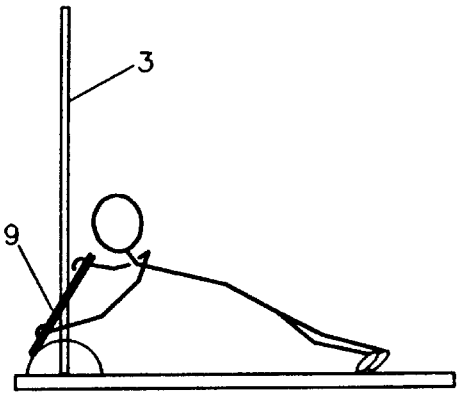

Push ups can be done as shown in the schematic of FIG. 22. Here the t-bar 9 is secured to the pole 3 locked in the vertical position and the exerciser can perform push-ups by grasping the t-bar with his or her hands and his or her feet resting on the planar base and raising his or her body.

Figure 23:
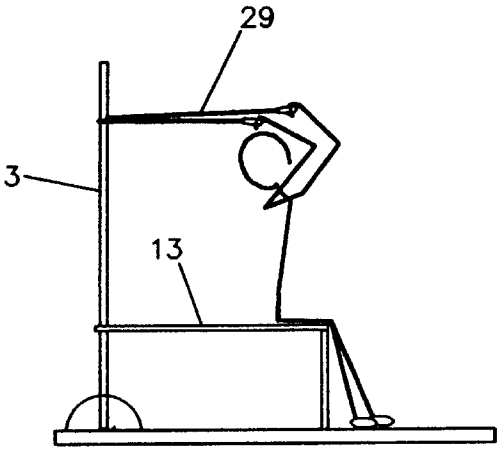

FIG. 23 depicts an exerciser doing pull overs. The pole 3 is secured in the vertical position and the exerciser stretches elastic cords 29 attached to the pole 3 while sitting on the bench 13 such that his or her back faces the pole 3.

Figure 24:
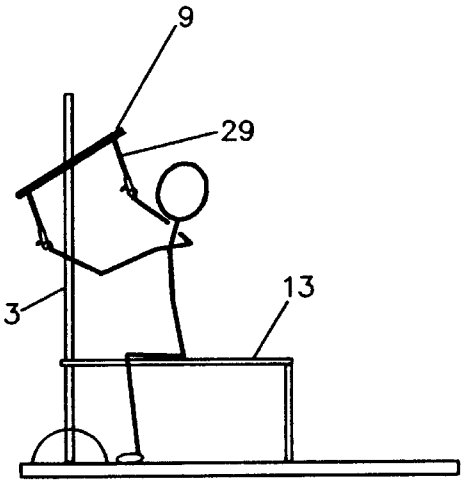

An exerciser can perform pull downs using this invention as depicted in the schematic of FIG. 24. To do this exercise the t-bar 9 is positioned on the pole 3 at an appropriate height above the exerciser's head while the exerciser is sitting on the bench 13 facing the pole 3. The exerciser stretches with his or her arms the elastic cords 29 attached to the t-bar 9.

Figure 25:
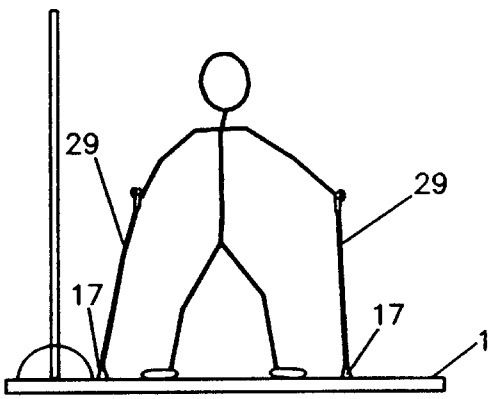

The schematic in FIG. 25 shows an exerciser performing a fly exercise. Here the exerciser stands on the planar base 1 and stretches upwardly with his or her arms elastic cords 29 attached at the other end to the elastic cord anchors 17.

Figure 26:
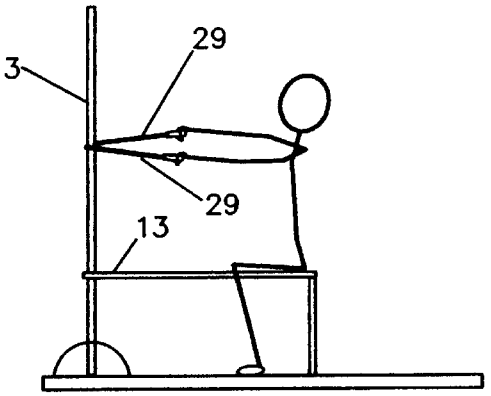

FIG. 26 is a schematic of an exerciser performing a rowing exercise. The exerciser attaches a pair of elastic cords 29 to the pole 3 secured in the vertical position and stretches the elastic cords 29 by pulling them towards himself or herself while seated on the bench 13 facing the pole 3.

Figure 27:
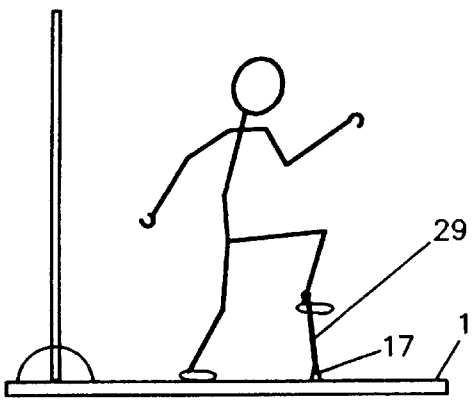

This invention supports a series of aerobic type exercises as depicted in the schematic drawings of FIGS. 27 through 32. In FIG. 27 an exerciser is using the device to jog in place. The exerciser stands on the planar base 1 and attaches an elastic cord to his footwear and the other end to an elastic cord anchor 17 and runs in place.

Figure 28:
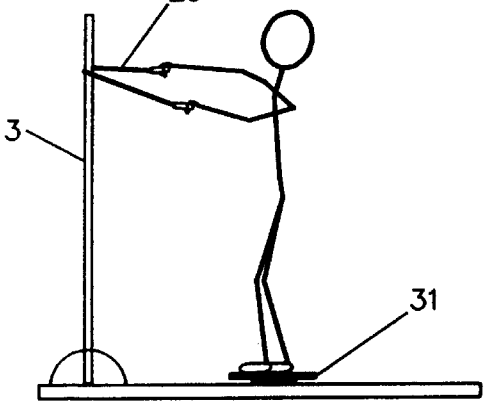

The exerciser as depicted in the schematic of FIG. 28 is performing a ski simulation exercise. A rotating disk is located in a hole 31 in the surface of the planar base upon which the exerciser stands with his or her feet and holds onto the ends of two elastic cords 29 which have the other end attached to the pole 3.

Figure 29:
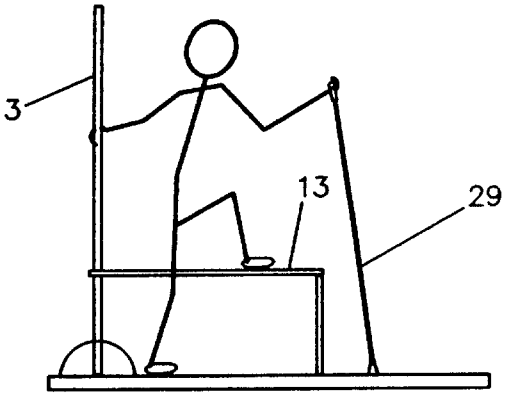

The schematic in FIG. 29 shows an exerciser performing step aerobics. Here the exerciser steps up and down on the bench 13. He or she may also hold onto the pole 3 and optionally use an elastic cord 29 attached to an elastic cord anchor 17.

Figure 30:
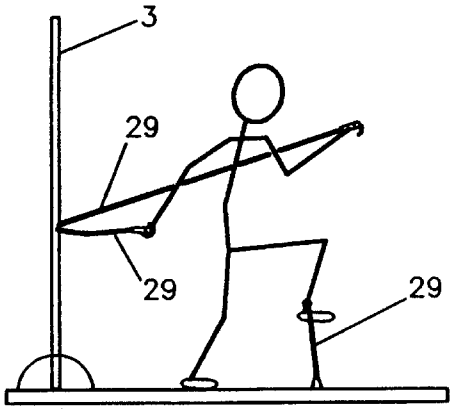

Aerobic power walking can also be performed with this invention. With the exercise's back to the pole 3, two elastic cords 29 are attached to the pole 3 and stretched with each arm and elastic cords 29 are attached to the exerciser's foot gear and the other end to the elastic cord anchors 17, the exerciser can perform in-place power walking as depicted in the schematic of FIG. 30.

Figure 31:
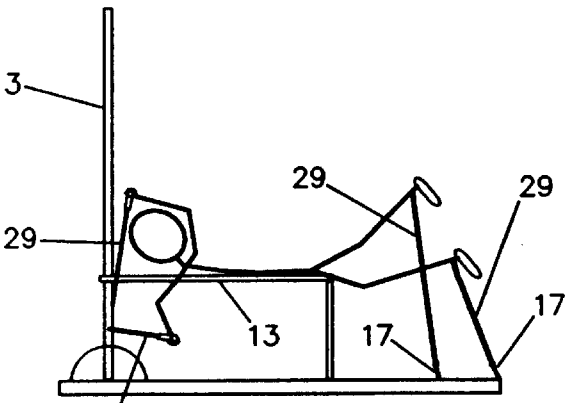

The schematic FIG. 31 shows an exerciser utilizing this invention for a simulated swimming exercise. The exerciser lies face down on the bench 13 with his or head toward the pole 3. With his or her arms in a swimming motion the exerciser stretches the elastic cords 29 attached to the pole 3. And his or her legs in a kicking motion the exerciser stretches the elastic cords attached to the elastic cord anchors 17.

Figure 32:
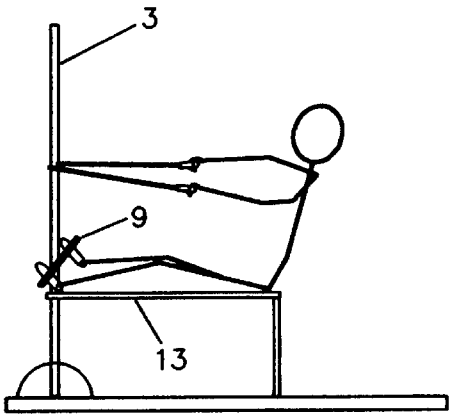

Another aerobic exercise that can be performed with this invention is the rowing exercise as shown in the schematic shown in FIG. 32. The exerciser sits on the bench 13 facing the pole 3. The t-bar 9 is positioned on the pole 3 at a convenient height above the bench 13 so that the exerciser can slip his or her feet under it.

Figure 33:
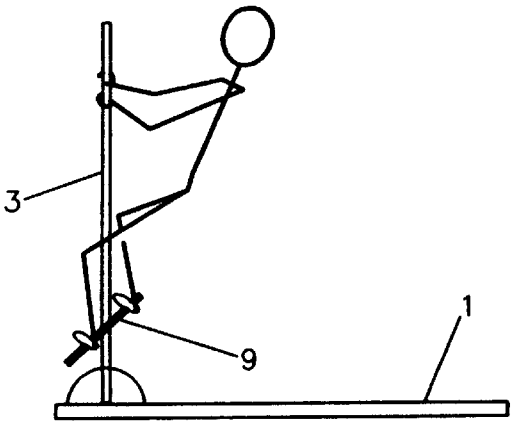

A series of leg exercises can be performed with the invention as shown in the schematics of FIGS. 33 through 43. FIG. 33 depicts a schematic wherein the exerciser uses the invention to perform toe raises and leg stretches. The pole 3 is secured in the vertical position and the t-bar 9 is secured to the pole 3 a convenient height above the planar base 1. The exerciser stands on the t-bar 9 with his or her feet and grasps the pole 3 with his or her hands and performs toe raises or leg stretches.

Figure 34:
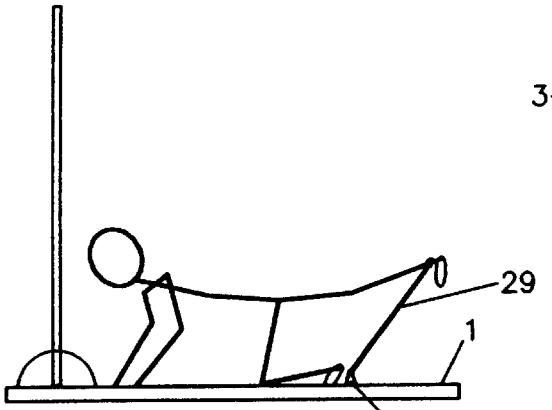

Donkey kicks can be performed with this invention as depicted in the schematic of FIG. 34. In this exercise the exerciser kneels on the planar base and stretches an elastic cord 29 attached to his or her footwear with his or her legs in a backward thrust motion. The other end of the elastic cord 29 is attached to an elastic cord anchor 17.

Figure 35:
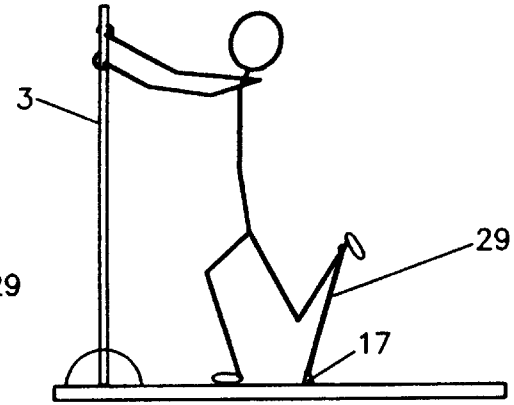

With the pole 3 positioned in the vertical position and the exerciser standing grasping the pole with his or her hand, leg curls can be performed. The exerciser stretches with a rear upward motion an elastic cord 29 with one attached to his or her footwear and the other end attached to an elastic cord anchor 17. This exerciser is shown in the schematic of FIG. 35.

Figure 36:
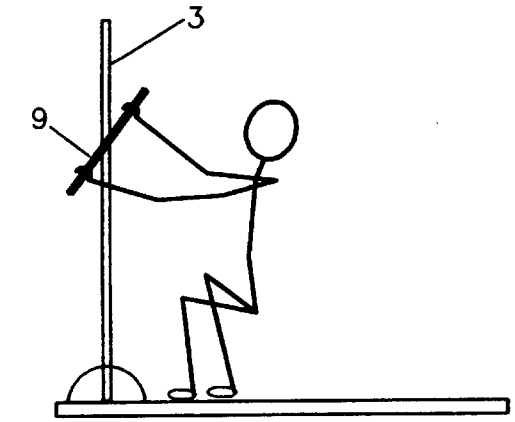

The schematic in FIG. 36 shows an exerciser performing squats with this invention. Here the exerciser faces the pole 3 vertically position with the t-bar 9 attached to the pole 3 at exerciser's chest height. The exerciser grasps the t-bar 9 with his or her hands and squats up and down exercising his or her leg muscles.

Figure 37:
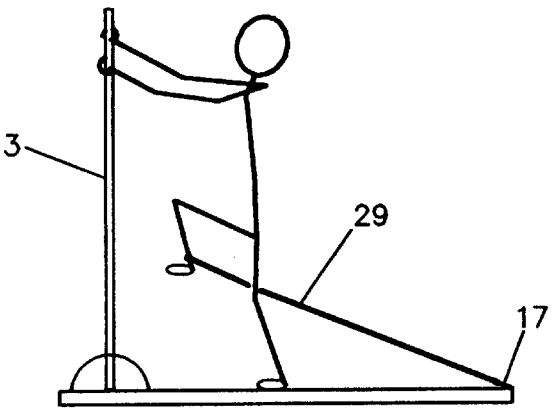

An exerciser, grasping the pole 3 with his or her hands while facing the pole and with elastic cords 29 attached to the his or her footwear and the other end of the elastic cord attached to the elastic cord anchors 17, can stretch the elastic cord 29 with his or her leg in a forward upward motion to perform a leg raise exercise. This use is depicted in the schematic of FIG. 37.

Figure 38:
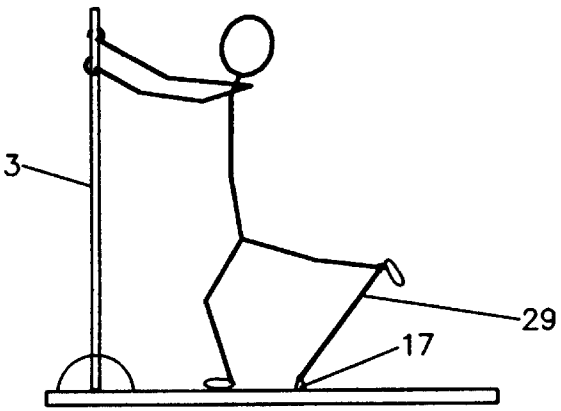

The schematic of FIG. 38 shows the exerciser performing a backward leg raise. In this exercise the exerciser grasps the pole 3 positioned in the vertical position with both hands. The elastic cords 29 are attached to his or her footwear with the other end attached the elastic cord anchors 17. The exerciser lifts his or her leg in an upward and rearward motion to stretch the elastic cord 29.

Figure 39:
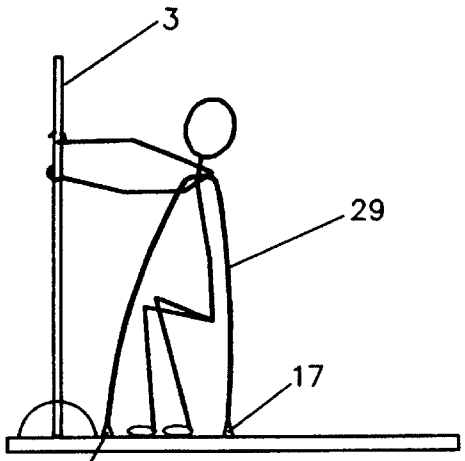

Further, the device can be used to perform heavy resistance squats as shown in the schematic of FIG. 39. In this use of the invention the exerciser grasps the pole 3 with both hands while facing the pole 3 and performs squats against an elastic cord 29 looped over the exerciser's shoulder and with both ends of the elastic cord attached to elastic cord anchors 17.

Figure 40:
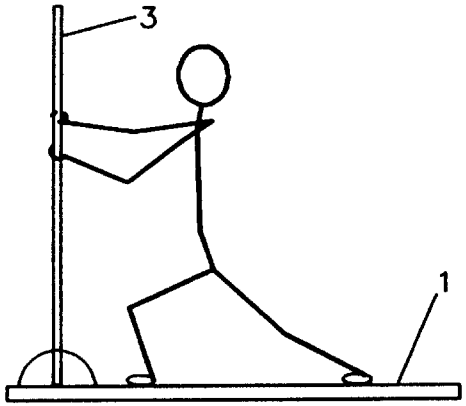

FIG. 40 depicts a schematic of an exerciser performing a lunge or stretch using this invention. Here the exerciser stands on the planar base 1, faces the pole 3, and grasps the pole 3 positioned in the vertical position with his or her hands and stretches out in the rearward direction his or her leg and performs lunges or stretches as desired.

Figure 41:
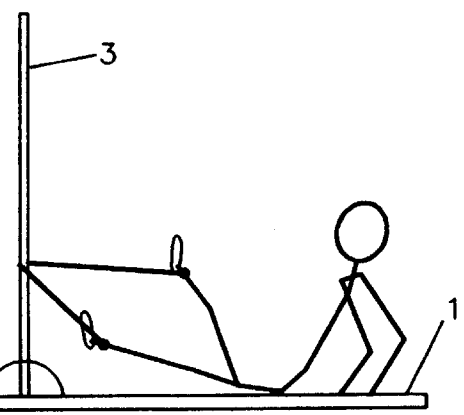

An exerciser can sit on the planar base facing the pole 3 and perform a scissors exercise with his or her legs as shown in the schematic of FIG. 41. The exerciser stretches the elastic cords 29 with one end of the elastic cord 29 attached to the exerciser's footwear and the other end attached to the pole 3 with his or her legs moving back and forth with a scissor like motion.

Figure 42:
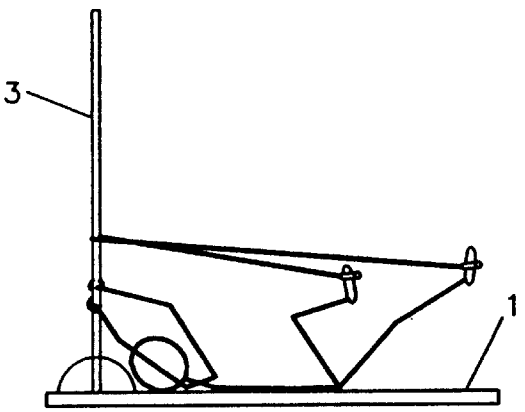

The schematic in FIG. 42 depicts an exerciser using this invention to perform leg thrusts. The exerciser lays with his or her back on the planar base 1 with his or her head toward the pole 3. The exerciser grasps the pole 3 with both hand over his or her head and stretches the elastic cords 29, which have one end attached to the exerciser footwear and the other end attached to the pole 3, with his or her legs with a leg thrusting motion.

Figure 43:
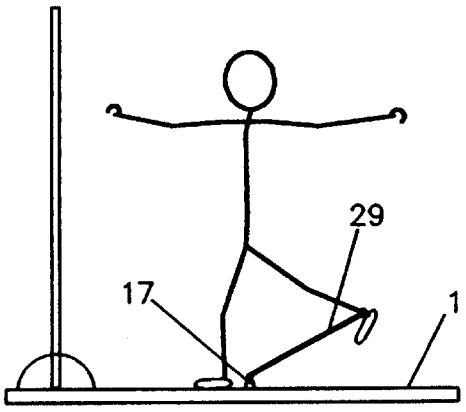

Side leg raises can be performed with this invention. The schematic in FIG. 43 shows an exerciser doing this. The exerciser stands on the planar base 1 and lifts his or her leg to the side with an elastic cord 29 attached to his or her footwear and the other end attached to an elastic cord anchor 17.

Figure 44:
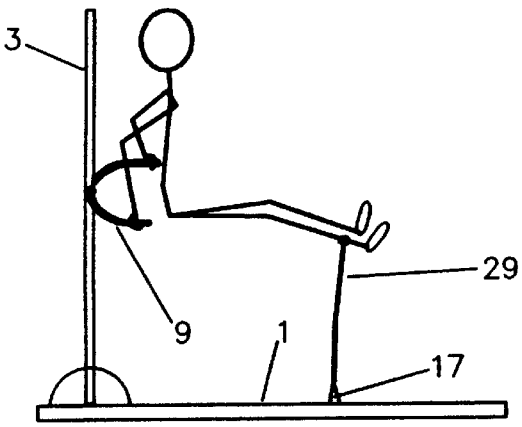

The schematics in FIGS. 44 to 49 depict an exerciser using this invention to perform back and stomach exercises. In the schematic of FIG. 44 the exerciser is performing a hanging double leg lift. In this use the pole 3 is secured in the vertical position with the curved t-bar 9 position on the pole 3 at a height above the exerciser's hips. The exerciser supports his or her body vertically with his or her arms by grasping the curved t-bar 9.

Then the exerciser lifts his or her leg and stretches an elastic cord 29, with one end is attached to his or her footwear and the other end attached to an elastic cord anchor 17, in an upward direction and downward resisting the-elastic cord 29.

Figure 45:
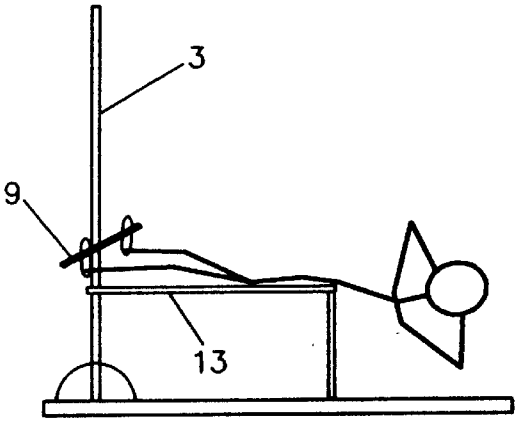

With the t-bar 9 positioned on the pole 3 secured in the vertical position above the bench 13 an exerciser laying on the bench 13 with his or her back toward the bench, head towards the pole 3 and feet looped under the t-bar 9 can perform back hyper-extensions as shown in the schematic of FIG. 45.

Figure 46:
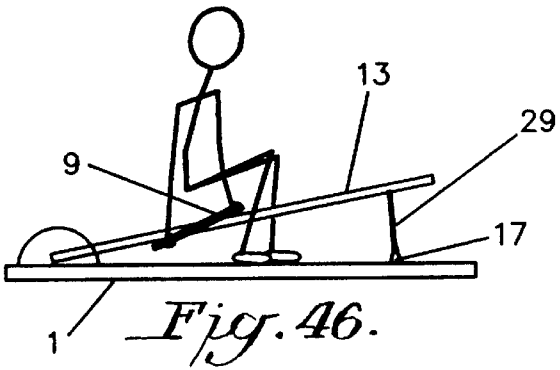

FIG. 46 shows a schematic of an exerciser performing a deadlift. In this exercise the pole 3 is not secured and allowed to rotate. The t-bar 9 is secured to the pole 3 and elastic cord is strung between the end of pole 3 and elastic cord anchor. The exerciser squats over the pole and lifts the t-bar 9 with his or her arms.

Figure 47:
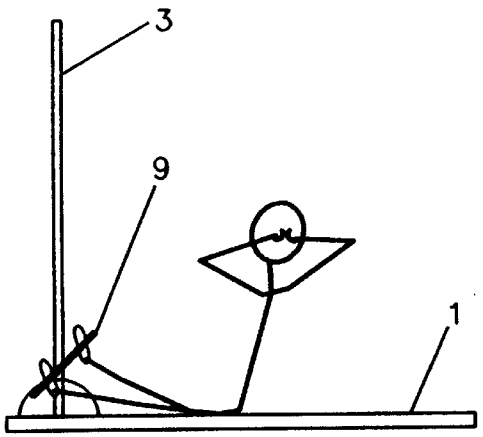
Figure 48:
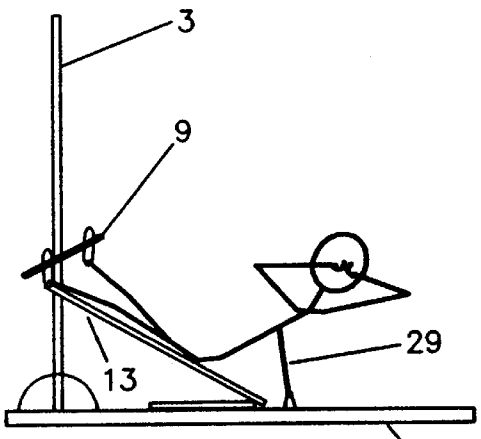

With the t-bar 9 secured above the planar base 1 to the pole 3 which is positioned in the vertical position, the exerciser can lay with his or her back on the planar base 1 and his or her feet beneath the t-bar 9 and perform before sit ups as depicted in the schematic of FIG. 47. FIG. 48 depicts an inclined sit up where the exerciser lays on the bench 13 with his or her back on the bench which is positioned in an inclined position. Alternatively, the exerciser can use an elastic cord 29 with the end attached to two different elastic cord anchors 17 to increase the resistance as shown in the figure.

Figure 49:
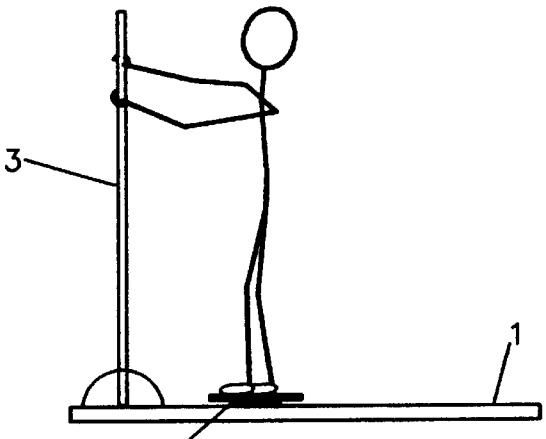

FIG. 49 is a schematic of the exerciser utilizing this invention for a twisting exercise. The exerciser stands on a twisting disk which is inserted in the hole 27, grasps the pole 3 secured in the vertical position with both hands and twists in both directions in an alternating motion.

It is to be understood that the above descriptions of uses of device 10 are solely for exemplary purposes. Other uses will be apparent to those of ordinary skill in the art given to the teachings of this invention. It is also to be understood that where various features are described with respect to certain embodiments those features may also be used with respect to other embodiments.

What is claimed is:

1. A portable exercise device comprising a rigid planar base having a horizontal upper surface, said base having elongated side edges joined to each other by end edges, a support bracket mounted to said upper surface, a co-arcuate array of positioning locations on said bracket, a vertically disposed pole having an upper end and a lower end, said pole being generally centrally mounted inwardly between said side edges of said base, mounting elements mounting said lower end of said pole to said bracket selectively at one of said positioning locations whereby the angular orientation of said pole may be varied with respect to said upper surface, said mounting elements permitting said pole to be disposed in a completely collapsed horizontal condition during non-use of said device, and a body supporting member on said upper surface for supporting the user while the user is performing an exercisers wherein said body supporting member is a bench having two platform sections hinged together, and one of said platform sections being mounted to said pole with the other of said platform sections mounted to said base generally centrally inwardly between said side edges.

2. A portable exercise device comprising a rigid planar base having a horizontal upper surface, a support bracket mounted to said upper surface, a co-arcuate array of positioning locations on said bracket, a vertically disposed pole having an upper end and a lower end, mounting elements mounting said lower end of said pole to said bracket selectively at one of said positioning locations whereby the angular orientation of said pole may be varied with respect to said upper surface, said mounting elements permitting said pole to be disposed in a completely collapsed horizontal condition during non-use of said device, a body supporting member on said upper surface for supporting the user while the user is performing an exercise, said body supporting member being a bench having two platform sections hinged together, one of said platform sections being mounted to said pole, and said one platform section being vertically adjustably mounted to said pole.

3. The device of claim 2 including an abdominal exercise device mounted on said bench.

4. The device of claim 2 including a rigid exercise bar mounted to said pole.

5. The device of claim 4 wherein said exercise bar is vertically adjustably mounted to said pole.

6. The device of claim 5 including elastic cords mounted to said base.

7. The device of claim 5 including elastic cords mounted to said pole.

8. The device of claim 5 wherein said body support is selectively mounted in a collapsed condition for storage and transportation, and said pole being selectively mounted in a collapsed condition.

9. The device of claim 8 including handle structure on said base to facilitate the carrying of said base.

10. The device of claim 9 wherein said base is hinged to permit said base to be folded upon itself during storage and transportation.

11. The device of claim 10 wherein said pole is telescopically mounted.

12. The device of claim 11 wherein said collapsible mounting is a detachable mounting.

13. The device of claim 1 wherein said body supporting member is a twister mounted inwardly of said side edges and end edges.

14. The device of claim 1 wherein said bracket includes a mounting hole disposed within said array of positioning locations, said positioning locations being locking holes, said mounting elements being a first pin and a second pin, said first pin being in said pole and said mounting hole to act as a pivot pin, and said second pin being in one of said locking holes and said pole to lock said pole against rotational movement.

15. A portable exercise device comprising a rigid planar base having a horizontal upper surface, a support bracket mounted to said upper surface, a co-arcuate array of positioning locations on said bracket, a vertically disposed pole having an upper end and a lower end, mounting elements mounting said lower end of said pole to said bracket selectively at one of said positioning locations whereby the angular orientation of said pole may be varied with respect to said upper surface, said mounting elements permitting said pole to be disposed in a completely collapsed horizontal condition during non-use of said device, a body supporting member on said upper surface for supporting the user while the user is performing an exercise, said bracket including a mounting hole disposed within said array of positioning locations, said positioning locations being locking holes, said mounting elements being a first pin and a second pin, said first pin being in said pole and said mounting hole to act as a pivot pin, said second pin being in one of said locking holes and said pole to lock said pole against rotational movement, said body supporting member being a bench detachably mounted to said pole, said bench being disposed generally horizontally against said upper surface of said base during non-use of said device, and said first pin being detached from said pole and said pole pivoting about said second pin to a generally horizontal position above and against said bench during non-use of said device.

16. The device of claim 15 wherein said base is folded against itself with outer surface against outer surface during nonuse of said device.

17. A portable exercise device comprising a rigid planar base having a horizontal upper surface, said base having elongated side edges joined to each other by end edges, a support bracket mounted to said upper surface, a co-arcuate array of positioning locations on said bracket, a vertically disposed pole having an upper end and a lower end, said pole being generally centrally mounted inwardly between said side edges of said base, mounting elements mounting said lower end of said pole to said bracket selectively at one of said positioning locations whereby the angular orientation of said pole may be varied with respect to said upper surface, said mounting elements permitting said pole to be disposed in a completely collapsed horizontal condition during non-use of said device.

18. The device of claim 17 wherein a rigid exercise bar is slidably mounted on said pole.

19. The device of claim 18 wherein a rigid exercise bar is detachably mounted to said pole.

20. The device of claim 19 wherein elastic cords are mounted to said rigid exercise bar.

21. A portable exercise device comprising a rigid planar base having a horizontal upper surface, a support bracket mounted to said upper surface, a co-arcuate array of positioning locations on said bracket, a vertically disposed pole having an upper end and a lower end, mounting elements mounting said lower end of said pole to said bracket selectively at one of said positioning locations whereby the angular orientation of said pole may be varied with respect to said upper surface, said mounting elements permitting said pole to be disposed in a completely collapsed horizontal condition during non-use of said device, said base having hand accommodating structure to facilitate the carrying of said base, at last one elastic cord mounted to said base, and said elastic cord having a free end accessible at said upper surface of said base.

22. The device of claim 21 wherein a plurality of said elastic cords are provided, some of said elastic cords being mounted to said base and other of said elastic cords being mounted to said pole.

23. The device of claim 1 including an abdominal exercise device mounted on said bench.

24. The device of claim 1 including a rigid exercise bar mounted to said pole.

25. The device of claim 24 wherein said exercise bar is vertically adjustably mounted to said pole.

26. The device of claim 1 including elastic cords mounted to said base.

27. The device of claim 1 including elastic cords mounted to said pole.

28. The device of claim 1 wherein said body support is selectively mounted in a collapsed condition for storage and transportation, said pole being selectively mounted in a collapsed condition.

29. The device of claim 28 including handle structure on said base to facilitate the carrying of said base.

30. The device of claim 28 wherein said base is hinged to permit said base to be folded upon itself during storage and transportation.

31. The device of claim 30 wherein said pole is telescopically mounted.

32. The device of claim 31 wherein said collapsible mounting is a detachable mounting.

* * * * *